US010697602B2

(12) United States Patent
Manassero et al.

(10) Patent No.: US 10,697,602 B2
(45) Date of Patent: Jun. 30, 2020

(54) MOTOR VEHICLE LIGHTING DEVICE

(71) Applicant: Valeo Vision, Bobigny (FR)

(72) Inventors: Adrien Manassero, Bobigny (FR); David Bourdin, Bobigny (FR)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 16/227,847

(22) Filed: Dec. 20, 2018

(65) Prior Publication Data

US 2019/0195451 A1 Jun. 27, 2019

(30) Foreign Application Priority Data

Dec. 21, 2017 (FR) ..... 17 62766

(51) Int. Cl.

| | |
|---|---|
| ***F21S 41/25*** | (2018.01) |
| ***F21S 41/39*** | (2018.01) |
| ***F21S 41/37*** | (2018.01) |
| ***F21S 41/43*** | (2018.01) |
| ***F21S 41/47*** | (2018.01) |

(Continued)

(52) U.S. Cl.

CPC ..... *F21S 41/25* (2018.01); *F21S 41/143* (2018.01); *F21S 41/147* (2018.01); *F21S 41/285* (2018.01); *F21S 41/37* (2018.01); *F21S 41/39* (2018.01); *F21S 41/43* (2018.01); *F21Y 2115/10* (2016.08)

(58) Field of Classification Search

CPC ..... F21S 41/25; F21S 41/37; F21S 41/147; F21S 41/143; F21S 41/39; F21S 41/43; F21S 41/285; F21Y 2115/10

See application file for complete search history.

(56) References Cited

U.S. PATENT DOCUMENTS 6,280,067 B1 * 8/2001 Albou ..... B60Q 1/1438 362/459

2008/0239745 A1 10/2008 Naganawa et al.

(Continued)

FOREIGN PATENT DOCUMENTS

DE 10 2008 015 510 A1 10/2008

DE 10 2010 046 021 A1 3/2012

(Continued)

OTHER PUBLICATIONS

French Preliminary Search Report dated Aug. 13, 2018 in French Application 17 62766 filed on Dec. 21, 2017 (with English Translation of Categories of Cited Documents).

*Primary Examiner* — Tracie Y Green

(74) *Attorney, Agent, or Firm* — Oblon, McClelland, Maier & Neustadt, L.L.P.

(57) ABSTRACT

A lighting device for motor vehicles including at least one first light source that is centered on and/or aligned with the optical axis of a projection lens of the lighting device, and a diaphragm element in order to form a cut-off profile in a first light beam shaped by the projection lens. This advantageous configuration enables reduction of chromatic defects linked to interaction between the diaphragm element and light rays generated by the first light source. The lighting device advantageously includes a second light source in order to be able, in collaboration with the first light source, to generate a second light beam. In this case, the diaphragm element is advantageously inclined on the second light source side relative to the optical axis of the projection lens.

18 Claims, 2 Drawing Sheets

(51) Int. Cl.

| | |
|---|---|
| ***F21S 41/143*** | (2018.01) |
| ***F21S 41/147*** | (2018.01) |
| ***F21S 41/20*** | (2018.01) |
| *F21Y 115/10* | (2016.01) |

(56) References Cited

U.S. PATENT DOCUMENTS

| | | | | |
|---|---|---|---|---|
| 2014/0016343 | A1 | 1/2014 | Brendle | |
| 2015/0085523 | A1* | 3/2015 | Gurtl | F21S 41/29 362/607 |
| 2016/0039330 | A1 | 2/2016 | Rosenhahn et al. | |
| 2016/0061398 | A1 | 3/2016 | Lee | |
| 2016/0186954 | A1 | 6/2016 | Han et al. | |
| 2017/0146210 | A1* | 5/2017 | David | F21S 41/435 |
| 2017/0241609 | A1 | 8/2017 | Luo et al. | |
| 2017/0292671 | A1 | 10/2017 | Gousset-Rousseau | |
| 2018/0180241 | A1* | 6/2018 | Huber | F21S 41/25 |
| 2019/0383457 | A1* | 12/2019 | Donoso | F21S 41/24 |
| 2020/0004039 | A1* | 1/2020 | Ogasahara | H04N 5/3572 |

FOREIGN PATENT DOCUMENTS

| | | | |
|---|---|---|---|
| DE | 10 2011 013 211 | A1 | 9/2012 |
| DE | 10 2013 227 194 | A1 | 7/2015 |
| DE | 10 2014 205 994 | A1 | 10/2015 |
| EP | 2 523 022 | A1 | 11/2012 |
| EP | 2 767 752 | A1 | 8/2014 |
| EP | 2 982 902 | A1 | 2/2016 |
| EP | 3 211 292 | A1 | 8/2017 |
| EP | 3 232 118 | A1 | 10/2017 |

* cited by examiner

MOTOR VEHICLE LIGHTING DEVICE

The present invention is in the field of the automotive industry, and more particularly concerns lighting devices, notably lights for motor vehicles.

In this field there are known lighting devices a light source of which associated with a projection lens enables generation of a light beam of the low beam type, or dipped beam type, with a range of close on 70 metres, essentially used at night. The configuration of a light beam of this kind makes it possible not to dazzle the driver of an approaching or following motor vehicle, through featuring a cut-off zone notably taking the form of a change of contrast curve, of which:

- a first part is situated below the horizon of a first side of the road on which a motor vehicle arriving in the opposite direction is liable to be found;
- a second part is situated above the horizon of a second side of the road opposite the first side relative to a centerline of said road;
- an oblique intermediate part joins the first part and the second part of the contrast changing curve at the level of a central region.

In a known manner, the cut-off zone is shaped by an element forming a diaphragm situated between the light source and the projection lens and making it possible to block the propagation of some of the light rays emitted by the light source that would be directed in an unwanted direction of the road—typically toward the first side of the road on which a motor vehicle arriving in the opposite direction is liable to be found. The diaphragm element can take the form of an optical element inside which a first portion of the light rays generated by the light source is transmitted and at a surface of which a second portion of the light rays generated by the light source is reflected.

A known disadvantage of this type of device resides in the chromatic defect noted at the level of the cut-off zone of the low beam: a border tinted red and/or blue appears at the level of said cut-off zone. This chromatic defect is linked to a difference in optical power between the first portion of the light rays generated transmitted by the diaphragm element and the second portion of the light rays reflected at said diaphragm element. In fact, most of the light rays generated by the light source are generally transmitted in the diaphragm element, and only a small portion of the light rays generated by the light source are reflected by the diaphragm element.

An object of the present invention is to address most of the above problems and moreover to lead to other advantages by proposing a new lighting device for motor vehicles.

Another object of the present invention is to reduce the chromatic defect of the lighting device, in particular at the level of the cut-off zone of the low beam.

According to a first aspect of the invention, at least one of the aforementioned objects is achieved with a lighting device for motor vehicles, said lighting device comprising (i) a support, (ii) a first light source fastened to the support and associated with a first collimator, a projection lens for shaping light rays generated by the first light source in order to generate a first light beam of "low beam" type, (iii) an element fastened to the support and forming a diaphragm for at least some of the light rays emitted by the first light source in order to generate a cut-off profile in the first light beam. According to a first aspect of the invention, the first collimator is centered relative to an optical axis of the projection lens.

The support of the lighting device according to the first aspect of the invention is a mechanical reference part to which the various elements of said lighting device are fastened—directly or indirectly—in order to enable them to collaborate and to generate at least the first light beam enabling production of at least the low beam as described above. By way of nonlimiting example, the support can take the form of a plate or of at least a part of a housing of said lighting device. The support can be made of metal or plastic material.

This advantageous configuration makes it possible to facilitate the optical alignment of the first light source relative to the projection lens. The projection lens is advantageously fixedly fastened to the support using any known fixing means, whether demountable or not. In particular, the projection lens can be fixed in an immobile manner to the support, via a mechanical connection allowing no degree of freedom between said projection lens and the support. In this case, the positioning and/or the orientation and/or the alignment of the projection lens relative to the support and/or to the light sources is or are carried out when mounting said projection lens on said support, with a factory adjustment that cannot be modified subsequently. Alternatively, the projection lens can be fixed to the support via a mechanical connection allowing at least one degree of freedom relative to said support and/or to the light sources, in order to enable adjustment of said projection lens for aligning it optically if necessary for correct functioning of the lighting device.

The first light source is associated with the first collimator so that some of the light rays generated by said first light source—and preferably all of the light rays generated by the first light source—are collected by said first collimator. In other words, the first collimator is adapted to collect at least some of the light rays emitted by the first light source and to redirect said light rays toward an entry face of the projection lens. The first collimator is preferably fastened to the support. The first light source can advantageously be fixedly fastened directly to the first collimator.

The diaphragm element can take several forms that will be described later. Generally speaking, the diaphragm element is adapted to prevent some of the light rays emitted in the direction of the projection lens by the first light source from propagating freely toward a part of the road that must not be lit by the low beam and/or to absorb them or to reorient them in another direction.

The projection lens of the lighting device according to the first aspect of the invention is adapted to shape the light rays passing through it in order to form at least the first light beam of "low beam" type.

An optical axis associated with the projection lens is defined by the median axis of the first light beam shaped by said projection lens. By "median axis" is meant for example a barycentric axis of the light rays generated by the first light source that have passed through the projection lens to form the first light beam. In other words, the median axis corresponds to the majority propagation direction of the first light beam.

In the direction of propagation of the light rays through the projection lens, said projection lens comprises an entry face through which the light rays penetrate into the projection lens, and an outlet face through which the light rays leave said projection lens.

In the remainder of the description, the terms "longitudinal", "lateral", "above", "below", "in front", "behind" refer to the orientation of the projection lens employed in the lighting device according to the first aspect of the invention, and notably with reference to the direction of propagation of the light rays that pass through it.

Starting from the optical axis of the first part of the projection lens, there are defined:

- a first, so-called end reference plane, perpendicular to the optical axis of the projection lens;
- a second, so-called transverse reference plane, perpendicular to the end plane and comprising the optical axis of the first part of the projection lens;
- a third, so-called sagittal reference plane, perpendicular to the end plane and to the transverse plane.

The transverse plane advantageously corresponds to a horizontal or substantially horizontal plane—to within the assembly and manufacturing tolerances—of the lighting device according to the first aspect of the invention, notably when it is mounted on a motor vehicle. Consequently, the intersection between the sagittal plane and the end plane preferably corresponds to a vertical or substantially vertical axis—to within the assembly and manufacturing tolerances.

Accordingly, the adjectives "longitudinal", "in front", and "behind" refer to a relative position considered in a direction substantially coincident with the optical axis of the projection lens. In an analogous manner, the adjectives "above", "high", "low" and "below" refer to a relative position substantially on an axis forming the intersection between the sagittal plane and the end plane, and the adjective "lateral" refers to a relative position substantially on an axis forming the intersection between the sagittal plane and the transverse plane.

In accordance with its first aspect, the invention aims to center the first light source relative to the optical axis of the projection lens of the lighting device. The first light source is more particularly aligned with the optical axis of the projection lens. For example, in the case of a surface type first light source, the optical axis of the projection lens intersects said first light source at the level of its light emitting surface, and preferably at its center.

This advantageous configuration enables a more even distribution of the light rays within the diaphragm element and therefore limits the chromatic defect at the level of the cut-off zone generated by said diaphragm element.

The lighting device according to the first aspect of the invention may advantageously comprise at least one of the following improvements, the technical features forming those improvements being considered separately or in combination:

- an optical axis of the first collimator is colinear with the optical axis of the projection lens. The first light source is optionally placed at the level of the optical axis;
- a longitudinal extremity of the diaphragm element situated on the projection lens side is positioned in the vicinity of a focus of the projection lens. The extremity of the diaphragm element situated on the projection lens side therefore enables shaping of the cut-off profile of the first light beam. The shape of the extremity of the diaphragm element situated on the projection lens side will be described later. The longitudinal extremity of the diaphragm element situated on the projection lens side is possibly slightly offset on the projection lens side relative to its focus in order to shape the cut-off profile of the first light beam;
- a focus of the first collimator is situated in the vicinity of the longitudinal extremity of the diaphragm element situated on the projection lens side, as a function of the manufacturing and/or assembly tolerances of the lighting device according to the first aspect of the invention. The focus of the first collimator preferably coincides exactly with the longitudinal extremity of the diaphragm element situated on the projection lens side. This advantageous configuration enables more precise shaping of the cut-off zone of the first light beam;
- according to one particularly advantageous embodiment of the invention, the lighting device according to the first aspect of the invention comprises a second light source fastened to the support and associated with a second collimator, the projection lens being adapted to shape light rays generated by the second light source in order to generate a complementary light beam that, collectively with the first light beam, forms a second light beam of "high beam" type, the second light source being situated on the opposite side to the first source relative to the optical axis of the projection lens. In other words, in this embodiment, the projection lens of the lighting device according to the first aspect of the invention enables the second light beam to be produced by complementarity of shape and/or position and/or orientation of the complementary light beam and the first light beam;
- the second light source and/or the second collimator are advantageously situated on an opposite side relative to the first light source and with reference to the optical axis of the projection lens;
- the second collimator is adapted to collect at least some of the light rays emitted by the second light source and to redirect them toward the entry face of the projection lens. A focus of the second collimator advantageously coincides with the longitudinal extremity of the diaphragm element situated on the projection lens side and/or with the focus of the projection lens in order to shape the complementary light beam more precisely;
- in the embodiment of the invention comprising two light sources, an angle formed by an elongation axis of the diaphragm element on the one hand and the optical axis of the projection lens on the other hand is non-zero, said diaphragm element being inclined on the second collimator side. In other words, the extremity of the diaphragm element situated on the light sources side is situated at a distance from the optical axis of the projection lens, while the extremity of the diaphragm element situated on the projection lens side is situated in the vicinity of or on the optical axis of the projection lens. This advantageous configuration enables both addition of the second light source to form the complementary light beam and placing the diaphragm element in a favourable configuration for forming the cut-off zone in the first light beam, despite the centered and/or aligned position of the first light source vis-à-vis the optical axis of the projection lens;
- in the embodiment of the invention comprising two light sources, the angle formed by the elongation axis of the diaphragm element on the one hand and the optical axis of the projection lens on the other hand is less than or equal to 90°, and preferably between 10° and 40° inclusive;
- the diaphragm element is reflective in order to prevent some of the light rays emitted by one or the other of the light sources from propagating in an unwanted direction, for example to the opposite side of the road in the case of emission of the first light beam of "low beam" type;
- in the embodiment of the invention comprising two light sources, a first portion of the light rays emitted by the first light source is reflected at the diaphragm element and a second portion of the light rays emitted by the first light source passes through the diaphragm element;

the diaphragm element has a metallized surface in order to contribute to the shaping and/or the reorientation of some of the light rays emitted by one or the other of the light sources. The metal surface can notably be obtained by depositing a metal—for example by electrolysis by cathode sputtering—and by polishing said surface;

the diaphragm element has a cut-off edge situated on the optical axis side of the projection lens that is concave over at least a part in order to generate a cut-off profile. Of course, the cut-off edge of the diaphragm element is situated, as stated above, on the projection lens side. In other words, the cut-off edge of the diaphragm element has at least one first part that is situated at a shorter distance from the optical axis of the projection lens compared to a second part of said cut-off edge. In other words, the cut-off edge is concave where it projects from the diaphragm element in the direction of the optical axis. The part of the cut-off edge that is concave is preferably situated on at least one lateral side of said cut-off edge relative to the optical axis of the projection lens. This advantageous configuration enables the diaphragm element to be more closed on the at least one lateral side and to pass fewer light rays in the direction of the projection lens, compared to the parts of said cut-off edge that are not concave. Consequently, it is possible to define a discontinuous cut-off profile in the first light beam, by appropriately adapting the concave shape of the cut-off edge of the diaphragm element;

the diaphragm element has a cut-off edge situated on the optical axis side of the projection lens that is convex over at least a part. In a manner analogous to the concave shape described above, the cut-off edge of said diaphragm element has at least one first portion that is situated at a greater distance from the optical axis of the projection lens compared to a second portion of said cut-off edge. In other words, the cut-off edge is convex when it is recessed in the diaphragm element and in a direction away from the optical axis of the projection lens. The portion of the cut-off edge that is convex is preferably situated on at least one lateral side of said cut-off edge relative to the optical axis of the projection lens. This advantageous configuration enables the diaphragm element to be more open on the at least one lateral side and to allow more light rays to pass in the direction of the projection lens, compared to the portions of the cut-off edge that are not convex. Consequently, it is possible to define a discontinuous cut-off profile in the first light beam, by appropriately adapting the convex shape of the cut-off edge of the diaphragm element. Of course, the concave and convex shapes of the cut-off edge of the diaphragm element can be combined with one another in order to form any type of cut-off profile, said cut-off edge being able to comprise at least one concave part and at least one convex part;

the diaphragm element takes the form of a plate that extends in the direction of the projection lens and of which at least one part is bevelled in order for a thickness of said plate on the projection lens side to be less than the thickness of the plate on the first light source side. This advantageous configuration enables improvement of the efficiency of the diaphragm element and better definition of a zone of interaction between said element and the light rays emitted by the first light source in order to form the cut-off profile of the first light beam;

the first light source and/or the second light source comprise(s) at least one light-emitting diode. The first light source and/or the second light source or sources can be addressed selectively or collectively. In a similar manner, when they comprise more than one light-emitting diode, the light-emitting diodes of the first light source and/or the light-emitting diodes of the second light source are addressable selectively or collectively. In this manner, when only the first light source is configured to emit light rays in the direction of the projection lens—via the diaphragm element, said light rays are then shaped by the projection lens in order to form the first light beam of "low beam" type. In this case, only the light emitting diode or diodes forming the first light source is or are configured to emit light rays. On the other hand, to form the second light beam of "high beam" type, the second light source is configured to emit light rays in the direction of the projection lens in order to form the complementary light beam, and the first light source is configured to emit light rays in the direction of said projection lens—via the diaphragm element—in order to form the first light beam: combining the first light beam and the complementary light beam enables production of the second light beam. In this case, the light-emitting diode or diodes forming the first light source is or are and the light-emitting diode or diodes forming the first light source is or are configured to emit light rays;

the projection lens is advantageously made of a plastic material and/or of glass. Polycarbonate (PC), polypropylene carbonate (PPC) or polymethyl methacrylate (PMMA) will preferably be used.

According to a second aspect of the invention, there is proposed a motor vehicle comprising a lighting device according to the first aspect of the invention or according to any one of its improvements. The lighting device advantageously forms a headlamp at the front of said motor vehicle.

Various embodiments of the invention are provided, integrating in all possible combinations the various optional features disclosed here.

Other features and advantages of the invention will become more apparent through on the one hand the following description of embodiments given by way of nonlimiting illustration with reference to the appended diagrammatic drawings on the other hand, in which.

Of course, the features, the variants and the various embodiments of the invention can be associated with one another, in various combinations, to the degree that they are not incompatible or mutually exclusive. There could notably be envisaged variants of the invention comprising only a selection of the features described hereinafter separately from the other features described, if that selection of features is sufficient to confer a technical advantage or to distinguish the invention from the prior art.

In particular all the variants and all the embodiments described can be combined with one another provided that there is nothing to oppose that combination from a technical point of view.

In the figures elements common to more than one figure retain the same reference.

Figure 1:
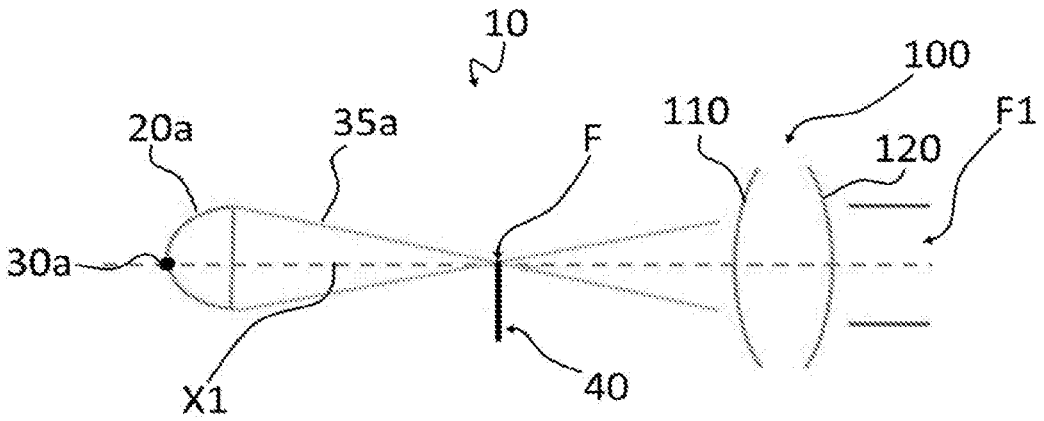
FIG. 1 is a diagrammatic view of a first example of a lighting device according to the first aspect of the invention comprising a single light source.

FIG. 1 is a diagrammatic side view of a first example of a lighting device 10 according to the first aspect of the invention and comprising:

- a single first light source 30*a* adapted to be able to emit light rays 35*a*, the first light source 30*a* being associated with a first collimator 20*a* in order to collect at least some of the light rays 35*a* emitted by said first light source 30*a* and to reorient them in the direction of a projection lens 100 of the lighting device 10;
- a projection lens 100 adapted to shape at least some of the light rays 35*a* emitted by the first source 30*a* and collected and reoriented by the first collimator 20*a* in order to form a first light beam F1, preferably corresponding to a "low beam" type beam. The light rays 35*a* emitted by the first source 30*a* more particularly penetrate into the projection lens 100 at the level of an entry face 110 and leave said projection lens 100 at the level of an exit face 120. Between the entry face 110 and the exit face 120 of the projection lens 100 the light rays 35*a* are deviated in order to be shaped so as to form the required light beam.

According to the first aspect of the invention, the first light source 30*a* and/or the first collimator 20*a* are centered on an optical axis X1 of the projection lens 100. The first light source 30*a* and/or the first collimator 20*a* are more particularly aligned with the optical axis X1. This alignment is obtained for example by placing an emitting surface of the first light source 30*a* perpendicular to the optical axis X1 of the projection lens 100. As a general rule, an alignment of this kind is obtained by causing the optical axis X1 of the projection lens 100 to correspond to an axis of propagation of the light rays emitted by the first light source 30*a* and/or a propagation axis of the light rays collected by the first collimator 20*a*. A propagation axis of this kind extends for example as a barycentric axis of all of the light rays emitted by the first light source 30*a* and/or collected and reoriented by the first collimator 20*a*. Moreover, the correspondence between the optical axis and one and/or the other of the foregoing propagation axes can be obtained by making them parallel or coincident.

At a focus F of the projection lens 100, the lighting device 10 comprises a diaphragm element 40 in order to oppose the free circulation of the light rays 35*a* emitted by the first light source 30*a* that would propagate on the side of the road that it is not intended to be lit by the low beam if said diaphragm element 40 were not present.

The diaphragm element 40 can take numerous forms, such as for example a bender or an optical component enabling absorption and/or deviation of some light rays 35*a* emitted by the first light source 30*a*.

According to the first aspect of the invention, the central and/or aligned position of the first light source 30*a* relative to the optical axis X1 of the projection lens 100, in collaboration with the diaphragm element 40, enables generation of a cut-off profile in the first light beam F1 that features a reduced or even no chromatic defect, for each wavelength constituting the light emitted by the first light source 30*a*, the interaction with the diaphragm element 40 is homogeneous. In other words, the luminous powers of the light rays deviated by the diaphragm element are equal or substantially equal, resulting in a reduced or even no chromatic defect.

Figure 2:
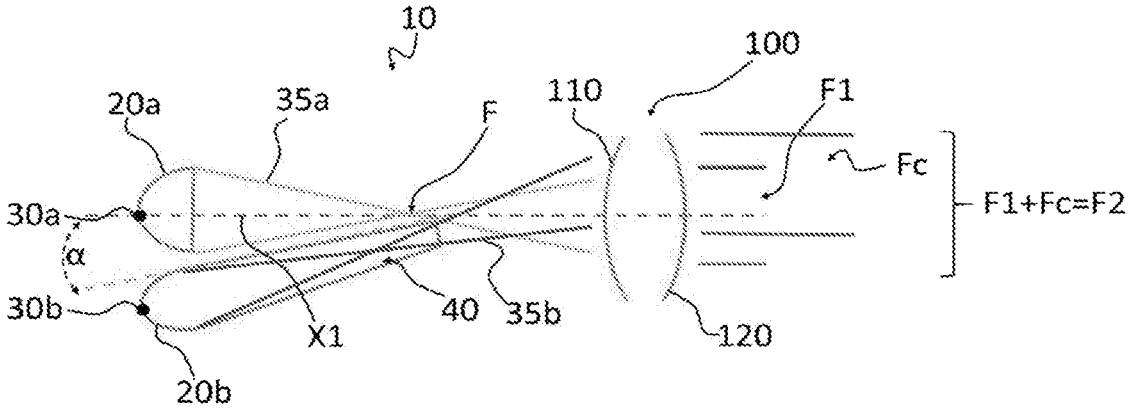
FIG. 2 is a diagrammatic view of a second example of a lighting device according to the first aspect of the invention comprising two light sources.

FIG. 2 is a diagrammatic side view of a second example of a lighting device 10 according to the first aspect of the invention comprising two light sources.

In a complementary way to the first example shown in FIG. 1, the lighting device 10 shown in FIG. 2 further comprises a second light source 30*b* associated with a second collimator 20*b* in order to collect the light rays 35*b* emitted by the second light source 30*b* and to send them in the direction of the projection lens.

The second light source 30*b* with its associated second collimator 20*b*, collectively with the projection lens 100, typically enable formation of a complementary light beam Fc which, associated with the first light beam F1, enables the formation of a second light beam F2 of the high beam type. In this case, the first light source 30*a* and the second light source 30*b* are collectively configured in order to emit light rays. However, the lighting device 10 is of course also adapted to be able to produce the first light beam F1: in this case, only the first light source 30*a* is configured to emit light rays 35*a*, as described above with reference to FIG. 1.

According to the invention, the diaphragm element 40 is inclined at an angle $\alpha$ relative to the optical axis X1 of the projection lens. This advantageous configuration enables optimization of the available space at the level of the light sources 30*a*, 30*b* and optimization of the cooling thereof.

In a complementary way, the inclined position of the diaphragm element 40 makes it possible to have to control only the dimensions and/or the shape and/or the position along the optical axis X1 of one extremity of the diaphragm element 40 situated on the projection lens 100 side. In fact, it is at the level of this longitudinal extremity situated on the projection lens 100 side that the diaphragm element 40 is conformed so as to interact with some of the light rays 35*a* emitted by the first light source 30*a* in order to form the cut-off profile in the first light beam F1.

An embodiment of a diaphragm element 40 of this kind will be described in more detail with reference to FIG. 3.

The angle $\alpha$ is preferably between 0° and 90° inclusive, which is advantageous, said angle $\alpha$ being counted as positive on the second light source 30*b* side relative to the optical axis X1. In other words, the diaphragm element 40 is preferably inclined relative to the optical axis X1 of the projection lens 100 on the second light source 30*b* side. According to one preferred embodiment, the angle $\alpha$ is between 10° and 40° inclusive, enabling optimum results to be obtained in terms of reducing the chromatic defect in the cut-off profile of the first light beam F1.

Figure 3:
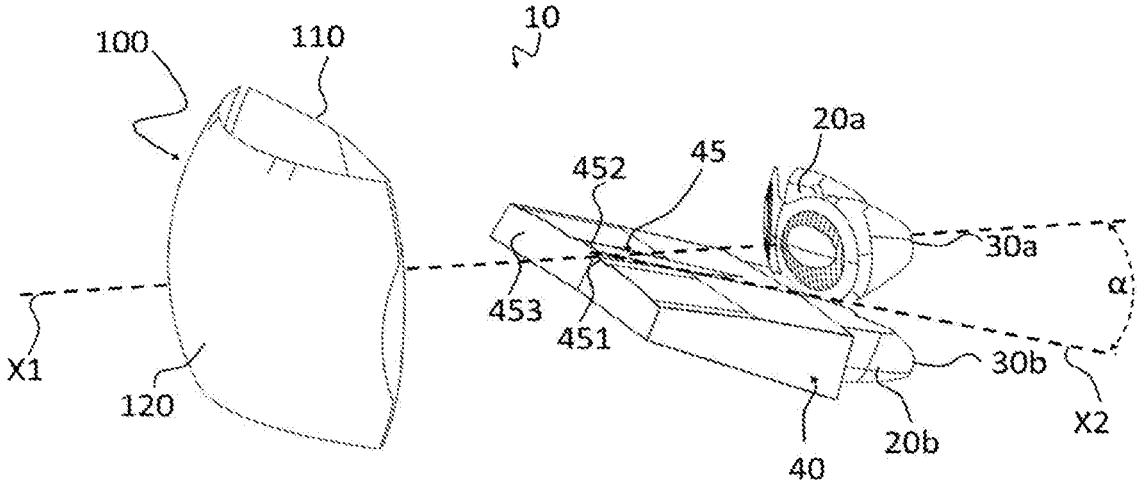
FIG. 3 is a perspective view of an embodiment of the second example of a lighting device according to the first aspect of the invention.

FIG. 3 is a perspective view of one embodiment of the second example of the lighting device according to the first aspect of the invention.

Conforming to what has been described above, the lighting device 10 shown in FIG. 3 comprises:

- a first light source 30*a* adapted to be able to emit light rays 35*a*, the first light source 30*a* being associated with a first collimator 20*a* in order to collect at least some of the light rays 35*a* emitted by said first light source 30*a* and to reorient them in the direction of a projection lens 100 of the lighting device 10;
- a second light source 30*b* adapted to be able to emit light rays 35*b*, the second light source 30*b* being associated with a second collimator 20*b* in order to collect at least some of the light rays 35*b* emitted by said second light source 30*b* and to reorient them in the direction of a projection lens 100 of the lighting device 10;
- a projection lens 100 adapted to shape at least some of the light rays 35*a*, 35*b* respectively emitted by the first light source 30*a* and the second light source 30*b* in order to form the first light beam F1 of "low beam" type and, when the second light source 30*b* is at the same time as the first light source 30*a* configured to emit light rays 35*b*, to shape the second light beam F2 of "high beam" type, as described above;

a diaphragm element 40 in order to oppose the free circulation of the light rays 35*a* emitted by the first light source 30*a* that would propagate to the side of the road that it is not intended to be lit by the low beam if said diaphragm element 40 were not present. As described above, the diaphragm element 40 enables generation of the cut-off profile in the first light beam F1.

According to the invention, the first light source 35*a* and/or the first collimator 20*a* are aligned and/or centered on the optical axis X1 of the projection lens 100, as described above.

The first collimator 20*a* takes the form of at least one concave cavity at the top of which the first light source 30*a* is placed in order to emit the corresponding light rays 35*a* into the concavity of the first collimator 20*a*. In the example shown in FIG. 3, the lighting device 10 comprises two first light sources 30*a* associated with two first collimators 20*a* in order to generate respective light rays 35*a* that are intended to light each side of the road. Each first light source 30*a* associated with its first collimator 20*a* is preferably situated on a different lateral side relative to the optical axis X1.

In a comparable manner, the lighting device 10 comprises two second light sources 30*b* associated with two second collimators 20*b* in order to generate respective light rays 35*b* that are intended to light each side of the road. Each second light source 30*b* associated with its second collimator 20*b* is preferably situated on a different lateral side relative to the optical axis X1.

Moreover, the first light sources 30*a* associated with their first collimators 20*a* are situated vertically on an opposite side relative to the second light sources 30*b* associated with their second collimators 20*b* relative to the optical axis X1 of the projection lens 100.

The light sources 30*a*, 30*b* are preferably of the type of at least one light-emitting diode of which at least one emission wavelength of the light rays 35*a*, 35*b* is at least in part included in the visible spectrum.

According to the invention, an elongation axis X2 of the diaphragm element 40 is inclined relative to the optical axis X1 of the projection lens 100. The elongation axis X2 of the diaphragm element 40 is more particularly inclined on the second light source 35*b* side at the angle α described above.

At the level of its front axial extremity 453, a cut-off edge 45 situated on the optical axis X1 side, that is to say the cut-off edge 45 of the diaphragm element 40 situated facing the first collimator 20*a* is conformed in such a manner as to oppose the free circulation of the light rays 35*a* emitted by the first light source 30. This opposition can take the form of absorption of said light rays 35*a* by the diaphragm element 40 and/or refraction of those light rays 35*a* by said diaphragm element 40.

To this end, the front axial extremity 453, the cut-off edge 45 of the diaphragm element 40 may comprise a concave part 452 and/or a convex portion 451 in order to generate the cut-off profile of the first light beam F1.

As described above, the cut-off edge 45 is concave where it projects from the diaphragm element 40 in the direction of the optical axis X1. The concave part 452 of the cut-off edge 45 is preferably situated on at least one lateral side of said cut-off edge 45 and relative to the optical axis X1 of the projection lens 100, for example a proximal side of the optical axis X1. This advantageous configuration enables the diaphragm element 40 to allow fewer of the light rays 35*a* generated by the first light source 30*a* to pass in the direction of the projection lens 100.

In addition to this or instead of this, the cut-off edge 45 is convex where it is recessed in the diaphragm element 40 and in a direction away from the optical axis X1 of the projection lens 100. The convex portion 451 of the cut-off edge 45 is preferably situated on at least one lateral side of said cut-off edge 45 relative to the optical axis X1. This advantageous configuration enables the diaphragm element 40 to allow more of the light rays 35*a* generated by the first light source 30*a* to pass in the direction of the projection lens 100.

The diaphragm element 40 is possibly reflective in whole or in part. In particular, at least one part of the cut-off edge 45 can be metallized.

The collimators 30*a*, 30*b* and/or the diaphragm element 40 and/or the projection lens 100 are advantageously made of plastic material and/or glass. If plastic would be preferable in order to reduce the weight of the lighting device 10 for example, polycarbonate (PC), polypropylene carbonate (PPC) or polymethyl methacrylate (PMMA) will preferably be used.

To summarize, the invention notably concerns a lighting device 10 for motor vehicles comprising at least one first light source 35*a* centered on and/or aligned with the optical axis X1 of a projection lens 100 of said lighting device 10, and a diaphragm element 40 in order to form a cut-off profile in a first light beam F1 shaped by said projection lens 100. This advantageous configuration enables reduction of the chromatic defects linked to interaction between the diaphragm element 40 and the light rays 35*a* generated by the first light source 30*a*. The lighting device 10 advantageously comprises a second light source 30*b* in order to be able, in collaboration with the first light source 30*a*, to generate a second light beam F2. In this case, the diaphragm element 40 is advantageously inclined on the second light source 30*b* side relative to the optical axis X1 of the projection lens 100.

Of course, the invention is not limited to the examples that have just been described and numerous adaptations can be made to those examples without departing from the scope of the invention. The various features, forms, variants and embodiments of the invention can notably be associated with one another in various combinations if they are not incompatible or mutually exclusive. In particular, all the variants and embodiments described above can be combined with one another.

The invention claimed is:

1. A lighting device for motor vehicles, the lighting device comprising:

a support;

a first light source fastened to the support and associated with a first collimator;

a projection lens, for shaping light rays generated by the first light source in order to generate a first light beam of "low beam" type; and an element fastened to the support and forming a diaphragm element for at least some of the light rays emitted by the first light source in order to generate a cut-off profile in the first light beam, the diaphragm element being a plate that extends toward the projection lens and is tapered such that a thickness of the plate decreases from a side of the plate proximate the first light source to a side of the plate proximate the projection lens, wherein the first collimator is centered relative to an optical axis of the projection lens.

2. The lighting device according to claim 1, wherein an optical axis of the first collimator is collinear with the optical axis of the projection lens.

3. The lighting device according to claim 1, wherein a longitudinal extremity of the plate extending toward the projection lens is positioned in a vicinity of a focus of the projection lens.

4. The lighting device according to claim 3, wherein a focus of the first collimator is proximate the longitudinal extremity of the plate.

5. The lighting device according to claim 1, wherein the lighting device further comprises a second light source fastened to the support and associated with a second collimator, the projection lens being adapted to shape light rays generated by the second light source in order to generate a complementary light beam that forms, collectively with the first light beam, a second light beam of "high beam" type, the second light source being situated askew of the optical axis of the projection lens.

6. The lighting device according to claim 5, wherein an angle formed by an elongation axis of the plate and the optical axis of the projection lens is non-zero, the plate being inclined toward the second collimator.

7. The lighting device according to claim 6, wherein the angle formed by the elongation axis of the plate and the optical axis of the projection lens is less than or equal to 90°.

8. The lighting device according to claim 7, wherein the angle formed by the elongation axis of the plate and the optical axis of the projection lens is between 10° and 40° inclusive.

9. The lighting device according to claim 5, wherein the plate is reflective.

10. The lighting device according to claim 9, wherein a first portion of the light rays emitted by the first light source is reflected at the plate and a second portion of the light rays emitted by the first light source are transmitted through the plate.

11. The lighting device according to claim 9, wherein the plate has a metallized surface.

12. The lighting device according to claim 1, wherein the plate has an edge situated proximate the optical axis of the projection lens that is concave over at least one part.

13. The lighting device according to claim 1, wherein the plate has a cut-off edge situated proximate the optical axis of the projection lens that is convex over at least a part.

14. The lighting device according to claim 5, wherein the first light source and/or the second light source comprise(s) at least one light-emitting diode.

15. The lighting device according to claim 2, wherein a longitudinal extremity of the plate extending toward the projection lens is positioned in a vicinity of a focus of the projection lens.

16. The lighting device according to claim 2, wherein the lighting device further comprises a second light source fastened to the support and associated with a second collimator, the projection lens being adapted to shape light rays generated by the second light source in order to generate a complementary light beam that forms, collectively with the first light beam, a second light beam of "high beam" type, the second light source being situated askew of the optical axis of the projection lens.

17. The lighting device according to claim 2, wherein the plate is reflective.

18. The lighting device according to claim 10, wherein the plate has a metallized surface.

* * * * *